US009713385B1

(12) United States Patent
Pan

(10) Patent No.: US 9,713,385 B1
(45) Date of Patent: Jul. 25, 2017

(54) LOWER-BACK SUPPORTING DEVICE OF CHAIR

(71) Applicant: Oasyschair Co., Ltd., Tainan (TW)

(72) Inventor: Toung-Chun Pan, Tainan (TW)

(73) Assignee: Oasyschair Co., Ltd., Tainan (TW)

( * ) Notice: Subject to any disclaimer, the term of this patent is extended or adjusted under 35 U.S.C. 154(b) by 0 days.

(21) Appl. No.: 15/071,444

(22) Filed: Mar. 16, 2016

(51) Int. Cl.
*A47C 7/46* (2006.01)

(52) U.S. Cl.
CPC ..... *A47C 7/46* (2013.01)

(58) Field of Classification Search
CPC ..... A47C 7/46
USPC ..... 297/284.4, 284.7
See application file for complete search history.

(56) References Cited

U.S. PATENT DOCUMENTS

| | | | | |
|---|---|---|---|---|
| 6,938,956 | B1 * | 9/2005 | Piretti | A47C 7/38 297/284.7 X |
| 7,517,024 | B2 * | 4/2009 | Cvek | A47C 7/282 297/284.4 |
| 9,332,851 | B2 * | 5/2016 | Machael | A47C 7/445 |
| 2016/0135603 | A1 * | 5/2016 | Chan | A47C 7/36 297/284.7 |

* cited by examiner

*Primary Examiner* — Anthony D Barfield
(74) *Attorney, Agent, or Firm* — Alan D. Kamrath; Kamrath IP Lawfirm, P.A.

(57) ABSTRACT

A lower-back supporting device of a chair includes: a backrest panel frame; a separately formed and elastic backrest panel mounted to the backrest panel frame, and at least one movement-limiting unit extending from a predetermined area of each of two corresponding inner lateral sides of the backrest panel frame and optionally arranged at a predetermined spacing. The bilaterally provided movement-limiting units clamp predetermined sections of a peripheral portion of the backrest panel and can be displaced vertically in order for the backrest panel to form a forwardly protruding lower-back supporting area at a predetermined height and to be leaned on elastically.

2 Claims, 10 Drawing Sheets

LOWER-BACK SUPPORTING DEVICE OF CHAIR

BACKGROUND OF THE INVENTION

1. Technical Field

The present invention relates to chairs and, more particularly, to a lower-back supporting device of a chair. An independently shaped backrest panel is connected to a backrest panel frame, with movement-limiting units mounted to predetermined areas of the backrest panel frame and configured to be displaced vertically to any of a plurality of predetermined heights, depending on a sitter's stature, so that a corresponding section of the backrest panel protrudes forward and can be leaned on comfortably.

2. Description of Related Art

Referring to FIG. 1, in order for a conventional chair 40 to be sat on comfortably, or more specifically with the sitter's upper and lower back well supported, it is common practice to equip the chair 40 with a backrest 20 which is connected to the rear side of a seat 10 and which not only has a predetermined width but also is shaped according to the human back. While the chair 40 does provide comfortable contact with a sitter's back, the shape of the backrest 20 is in most cases fixed and cannot be adjusted, making it impossible for those of different statures to have their lower backs in equally comfortable contact with the protruding section of the backrest 20. One who wishes to lean their lower back comfortably against the backrest 20 must, therefore, buy an additional lower-back or lumbar support 30 of an appropriate width and curvature, connect the lower-back or lumbar support 30 to the backrest 20, and then adjust the lower-back or lumbar support 30 vertically to the desired height.

This improvised solution is indeed capable of enabling comfortable contact with the lower backs of different sitters, but a commercially available lumbar support does not necessarily conform in width or curvature to (i.e., may be too wide, too narrow, too flat, or too curved for) the backrest of the chair in question. In view of this, the present invention provides a novel lower-back supporting device which achieves comfortable contact with a sitter's lower back by allowing vertical adjustment according to the sitter's stature.

BRIEF SUMMARY OF THE INVENTION

The present invention provides an improvement over the prior art, with the intention of overcoming the inconvenience of vertical adjustment of the conventional lumbar supports to be connected to the backrest of a chair. The improvement in a lower-back supporting device of a chair includes: a backrest panel frame, a separately formed and elastic backrest panel mounted to the backrest panel frame, and at least one movement-limiting unit extending from a predetermined area of each of two corresponding inner lateral sides of the backrest panel frame and optionally arranged at a predetermined spacing. The bilaterally provided movement-limiting units clamp predetermined sections of a peripheral portion of the backrest panel and can be displaced vertically in order for the backrest panel to form a forwardly protruding lower-back supporting area at a predetermined height and to be leaned on elastically.

The primary objective of the present invention is to enable convenient adjustment in height of the lower-back supporting area on the rear side of a chair so that the lower-back supporting area can be leaned on comfortably. To this end, a hollow backrest panel frame is formed along the rear side of the seat of a chair. At least one movement-limiting unit extends from a predetermined area of each of two corresponding inner lateral sides of the backrest panel frame. The at least one movement-limiting unit on each of the two corresponding inner lateral sides of the backrest panel frame corresponds to that on the other of the two corresponding inner lateral sides of the backrest panel frame, may be arranged at a predetermined spacing, and is configured to clamp the corresponding section of a peripheral portion of a separately formed backrest panel. The backrest panel is elastic, is mounted to the backrest panel frame, and has its upper sections retained by the backrest panel frame. When the bilaterally provided movement-limiting units are vertically displaced to a predetermined height, the backrest panel forms a forwardly protruding lower-back supporting area at the predetermined height to provide the user with an elastic leaning experience.

The second objective of the present invention is to ensure that the corresponding movement-limiting units extending respectively from the two corresponding inner lateral sides of the backrest panel frame work as intended. To this end, a receiving space is concavely provided in a predetermined area of each of the two corresponding inner lateral sides of the backrest panel frame in order to receive the corresponding movement-limiting unit. Each movement-limiting unit includes a slide rail, a clamping member, and a connecting member. The slide rail has a middle section penetrated by a slot through which the projection extending from one end of the connecting member can extend. A space is concavely provided in the inner side of the slide rail and has a lateral side concavely formed with at least one recess, which may be arranged at a predetermined space. The connecting member has a stop portion which is formed on one side of and spaced from the connecting member and which pushes outward constantly. The connecting member can be displaced along the space so that the stop portion is temporarily restricted by a corresponding one of the at least one recess of the slide rail. The clamping member is pressed against the outer side of the slide rail. The projection of the connecting member extends through the slot of the slide rail and is received in a corresponding groove of the clamping member. A threaded fastener is fastened in a corresponding hole of the connecting member and a corresponding hole of the clamping member to fix the connecting member and the clamping member together. The clamping member has one side formed with a recessed pressing section for clamping the peripheral portion of the backrest panel even during vertical displacement of the clamping member.

The third objective of the present invention is to ensure that each clamping member, when pressed against the outer side of the corresponding slide rail, can be displaced stably along the outer side of the corresponding slide rail. To this end, a sunken area is provided in a predetermined section of each clamping member.

DETAILED DESCRIPTION OF THE INVENTION

Figure 1:
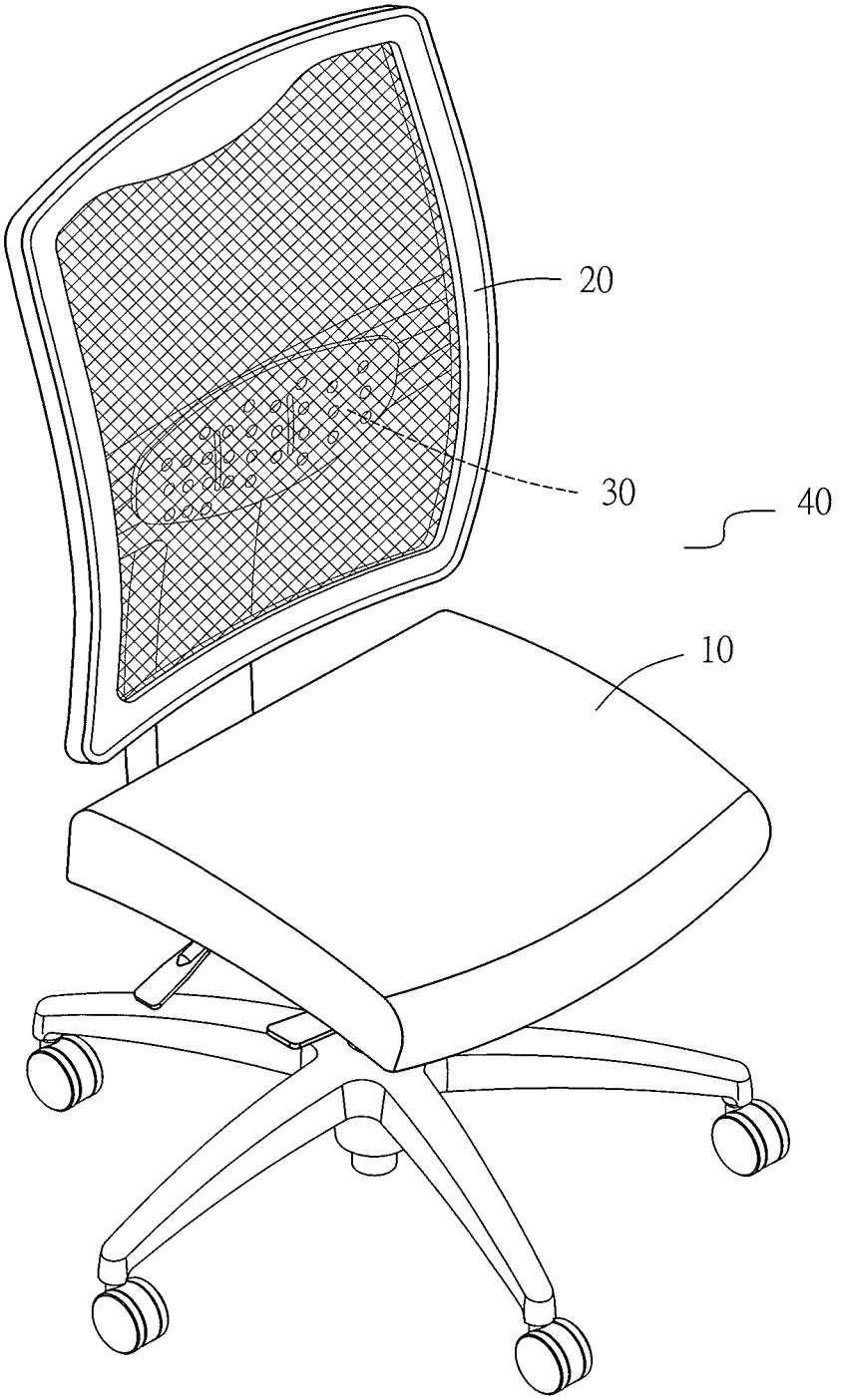
FIG. 1 (Prior Art)
FIG. 1 schematically shows a conventional chair mounted with a lumbar support.
Figure 2:
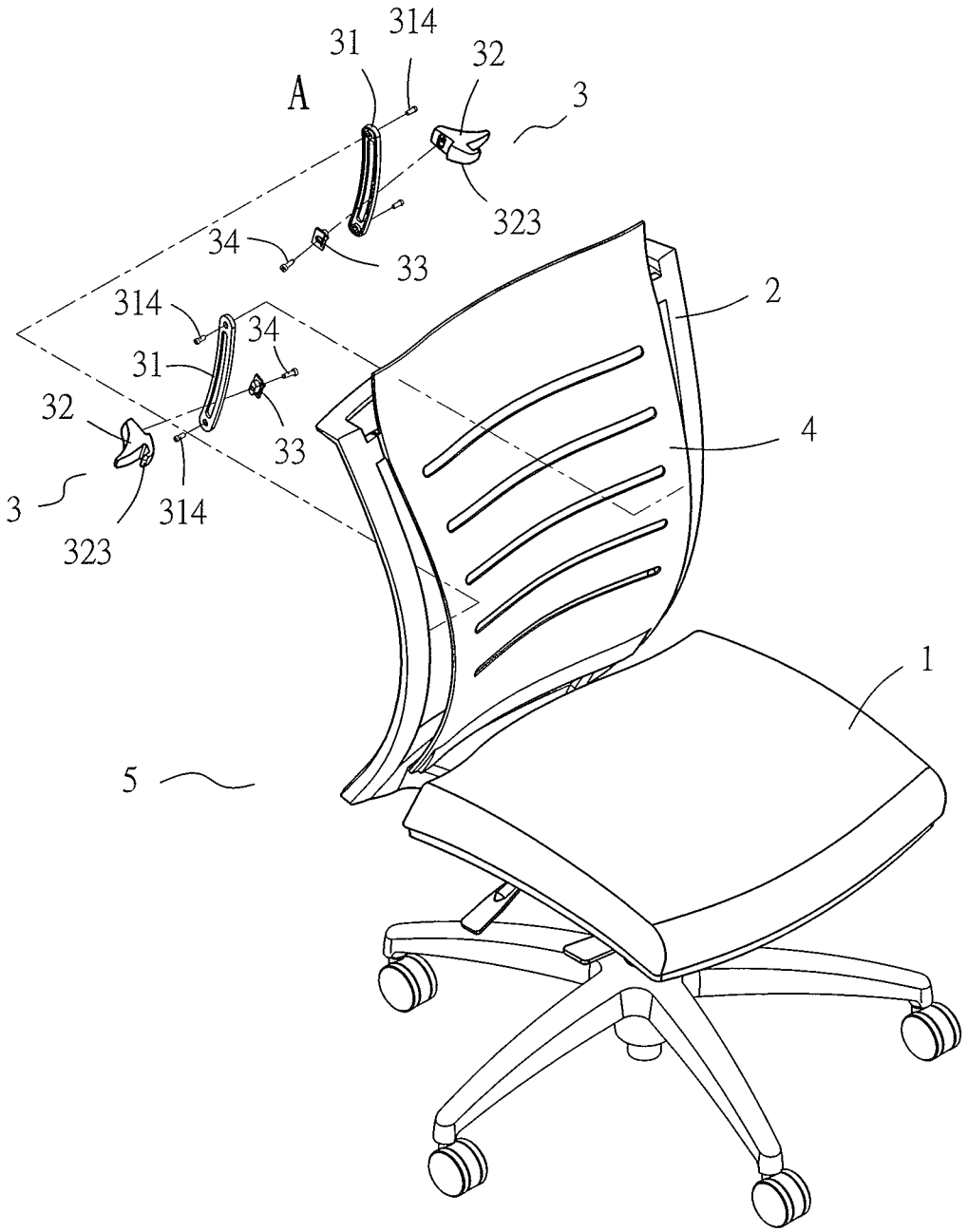
FIG. 2 is an exploded front perspective view of the lower-back supporting device of the present invention, showing in particular the backrest panel on the rear side of a chair and the movement-limiting units.
Figure 5:
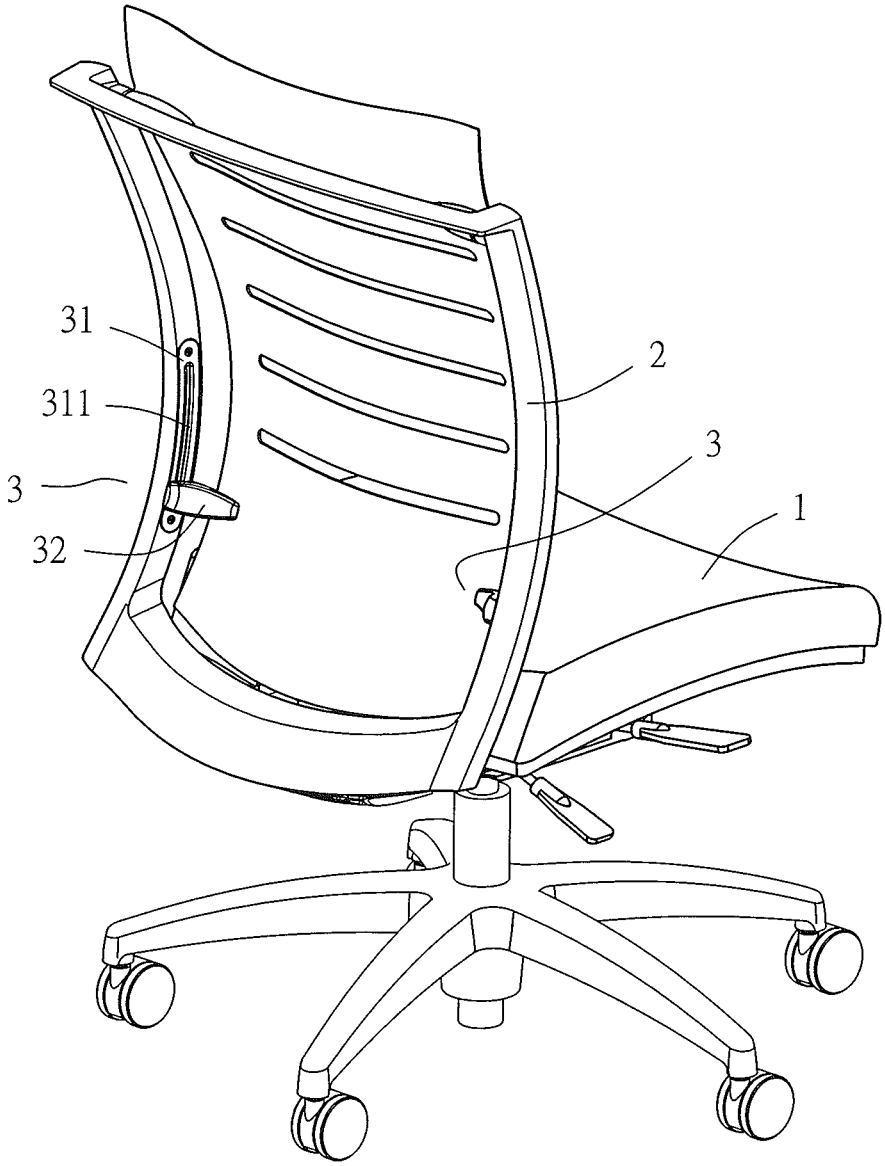
FIG. 5 is an assembled rear perspective view of the lower-back supporting device in FIG. 2.

The present invention provides a lower-back supporting device of a chair. Referring to FIG. 2, the present invention is applied to a chair 5, so that the lower-back supporting area on the rear side of the chair 5 can be easily adjusted in height and leaned on comfortably. A hollow backrest panel frame 2 is formed along the rear side of the seat 1 of the chair 5. At least one movement-limiting unit 3 extends from a predetermined area of each of two corresponding inner lateral sides of the backrest panel frame 2, as shown in FIG. 5. The at least one movement-limiting unit 3 on each of the two corresponding inner lateral sides of the backrest panel frame 2 corresponds to that on the other of the two corresponding inner lateral sides of the backrest panel frame 2, may be arranged at a predetermined spacing, and is configured to clamp a predetermined section of a peripheral portion of a separately formed backrest panel 4. The backrest panel 4 is elastic, is mounted to the backrest panel frame 2, and has two upper sections retained by the backrest panel frame 2. More specifically, at least one guiding portion extends from a predetermined area of each of the two upper sections of the backrest panel 4 and is vertically retained by a corresponding concave space in the backrest panel frame 2 (not shown). This retaining manner, however, is not a technical feature.

Figure 2A:
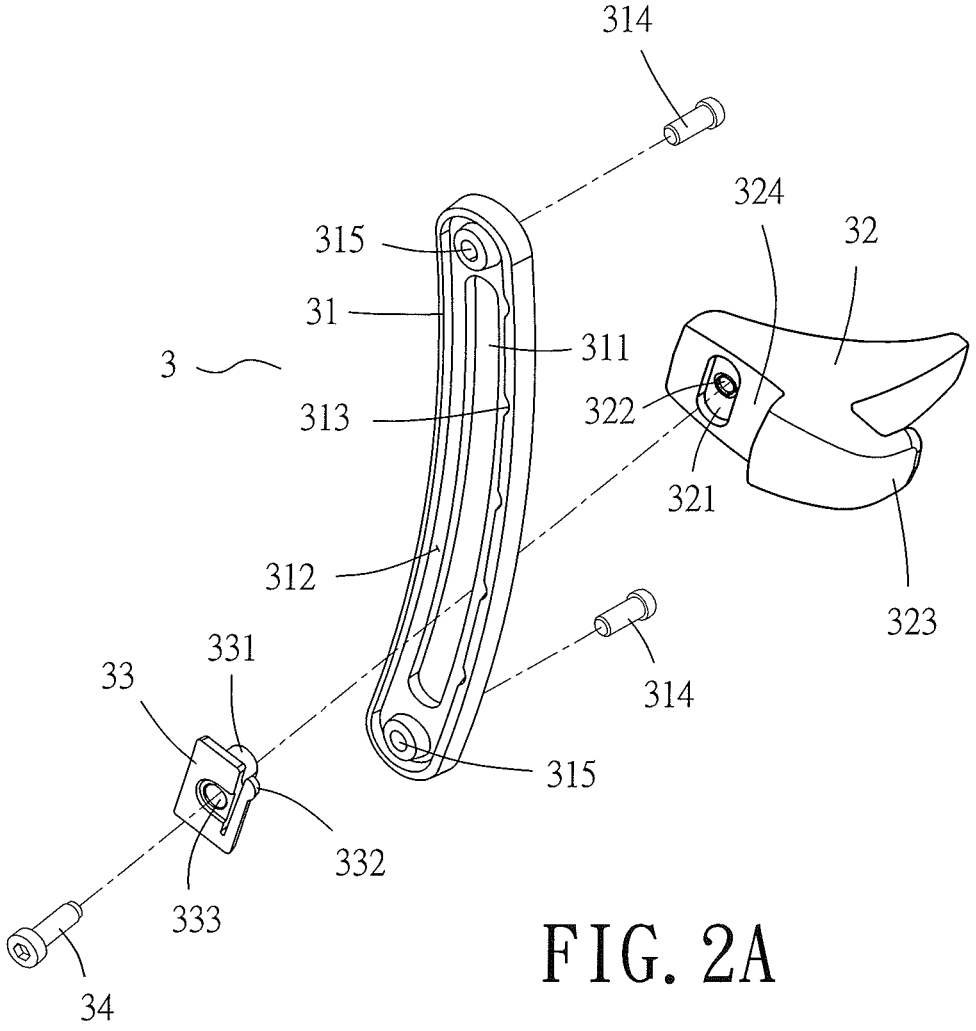
FIG. 2A is an enlarged view of the portion A in FIG. 2.
Figure 4:
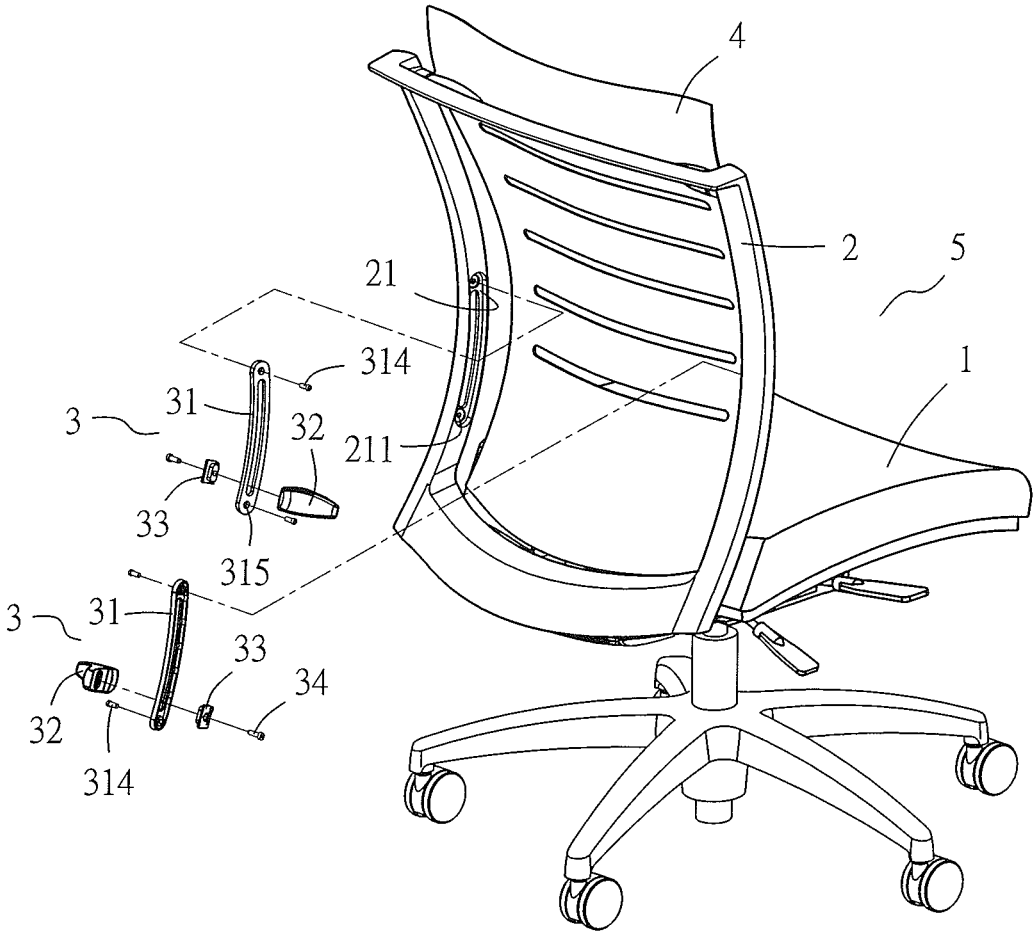
FIG. 4 is an exploded rear perspective view of the lower-back supporting device in FIG. 2.
Figure 6:
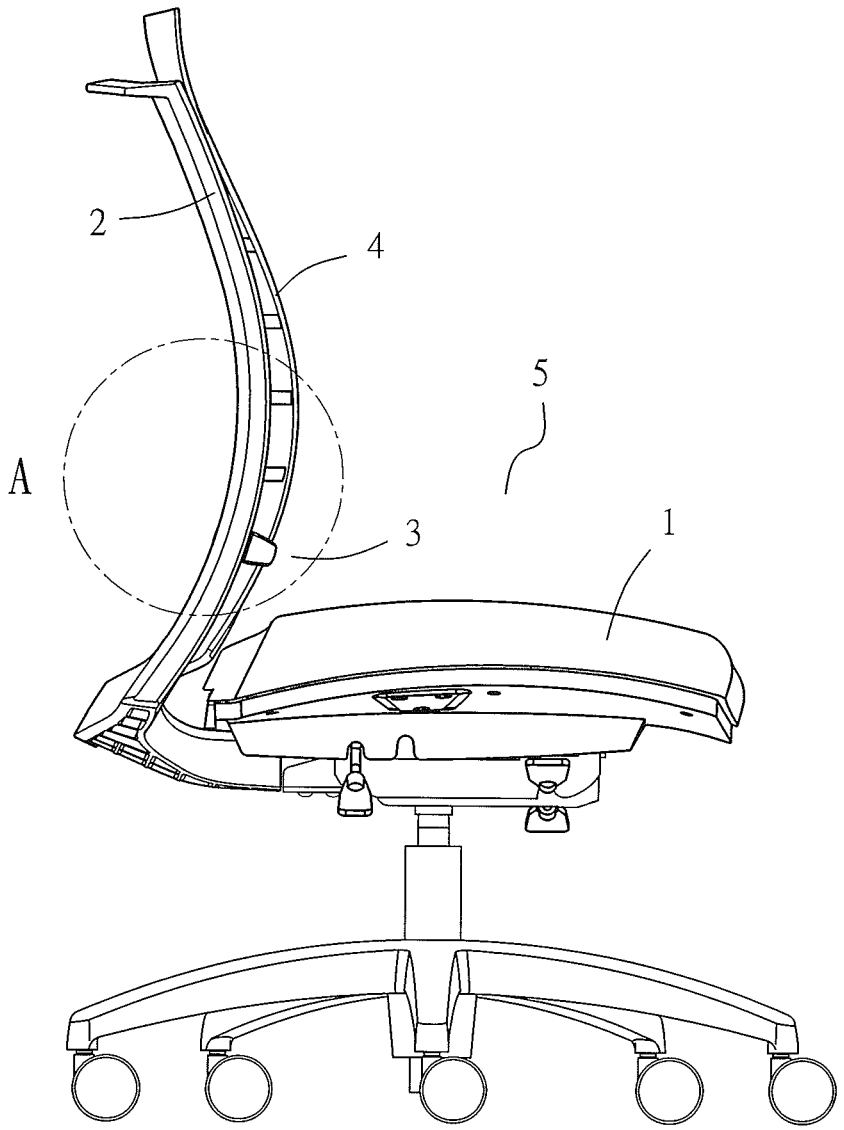
FIG. 6 is an assembled side view of the lower-back supporting device in FIG. 2.
Figure 6A:
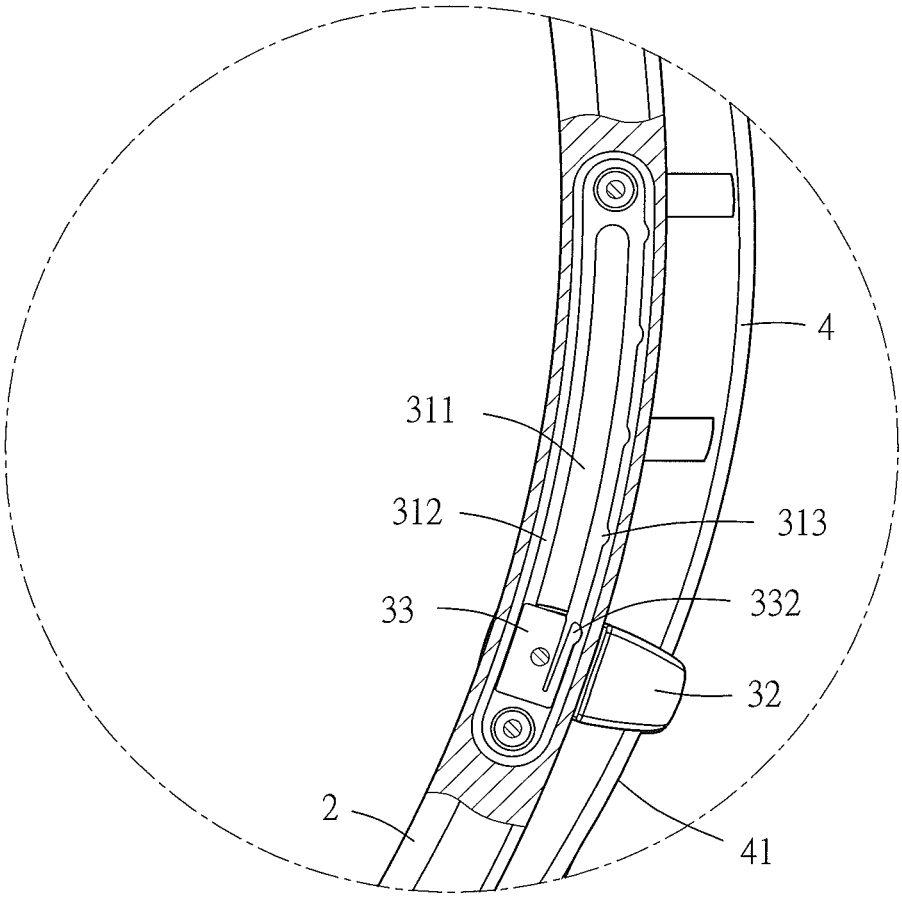
FIG. 6A is an enlarged sectional view of the portion A in FIG. 6.
Figure 7:
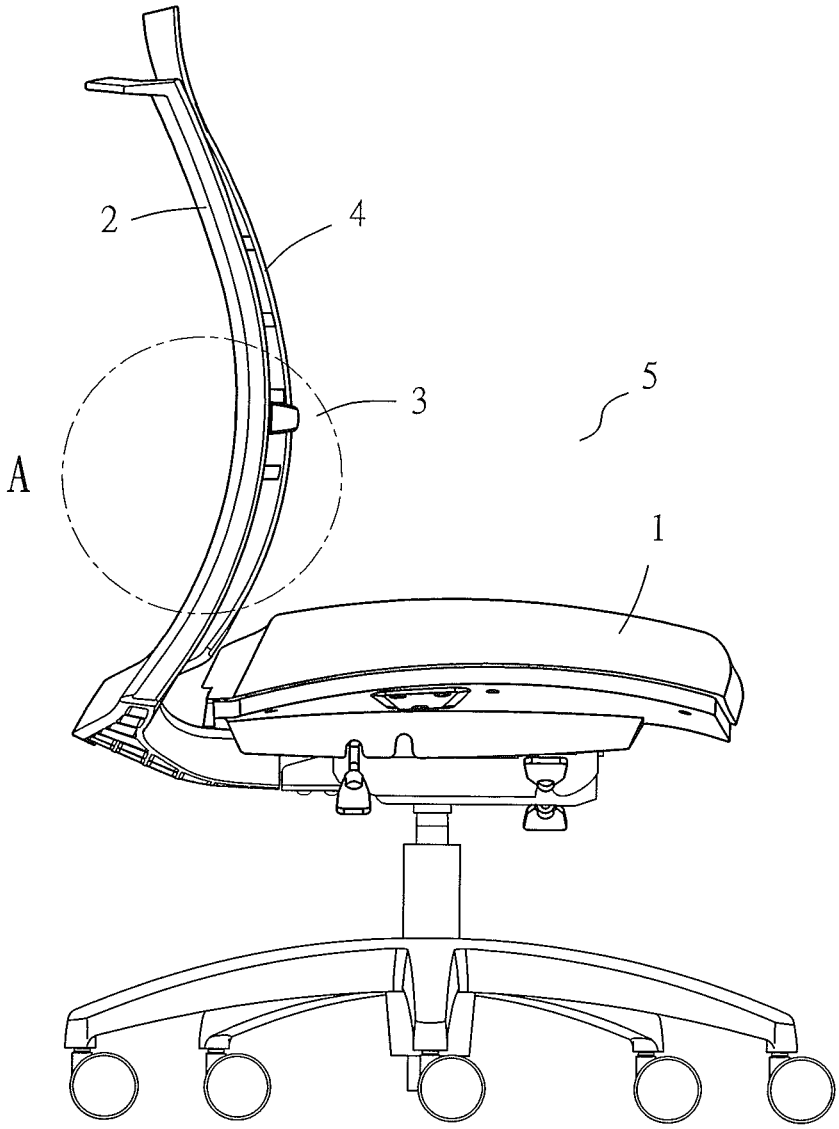
FIG. 7 is a side view in which the movement-limiting units in FIG. 6 have been moved upward such that the outwardly protruding lower-back supporting area of the backrest panel is displaced upward too.
Figure 7A:
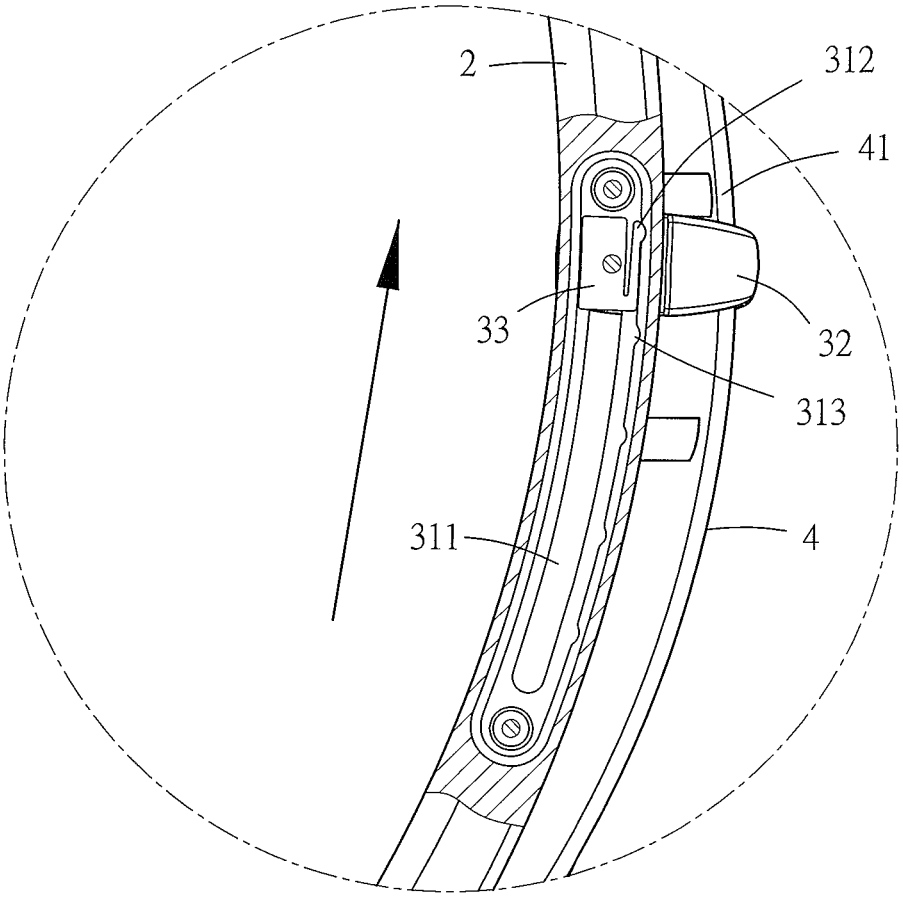
FIG. 7A is a sectional view of the portion A in FIG. 7.

The movement-limiting units 3 on the two corresponding inner lateral sides of the backrest panel frame 2 are configured as follows. Each movement-limiting unit 3, to be received in a receiving space 21 concavely provided in a predetermined area of one of the two corresponding inner lateral sides of the backrest panel frame 2 as shown in FIG. 4, includes a slide rail 31, a clamping member 32, and a connecting member 33, as shown in FIG. 2A. The slide rail 31 has a middle section penetrated by a slot 311 through which a projection 331 extending from one end of the connecting member 33 can extend. In addition, a space 312 is concavely provided in the inner side of the slide rail 31, and one lateral side of the space 312 is concavely formed with at least one recess 313, which may be arranged at a predetermined space. The connecting member 33 has a stop portion 332 which is formed on one side of and spaced from the connecting member 33 and which keeps pushing outward. The connecting member 33 can be displaced along the space 312, as shown in FIG. 6A and FIG. 7A, in order for the stop portion 332 to be temporarily restricted by the corresponding recess 313 of the slide rail 31. The clamping member 32 is pressed against the outer side of the slide rail 31. The projection 331 of the connecting member 33 extends through the slot 311 of the slide rail 31 and is received in a corresponding groove 321 of the clamping member 32. A threaded fastener 34 is fastened in a corresponding hole 333 of the connecting member 33 and a corresponding hole 322 of the clamping member 32 to fix the connecting member 33 and the clamping member 32 together. The clamping member 32 has one side formed with a recessed pressing section 323 for clamping the peripheral portion of the backrest panel 4 even when the clamping member 32 is vertically displaced, as shown in FIG. 6 and FIG. 7.

Moreover, a sunken area 324 is provided in a predetermined section of each clamping member 32. Thus, the clamping members 32, once pressed against the outer sides of the slide rails 31 respectively, can each be displaced stably along the outer side of the corresponding slide rail 31. After the movement-limiting units 3 are placed in the concave receiving spaces 21 in the backrest panel frame 2 respectively, referring to FIG. 4, a plurality of threaded fasteners 314 each pass through a corresponding hole 315 of one of the slide rails 31 and is then inserted into a corresponding hole 211 of the corresponding receiving space 21, thereby mounting the movement-limiting units 3 to the predetermined areas of the two corresponding inner lateral sides of the backrest panel frame 2 respectively, as shown in FIG. 5.

Figure 3:
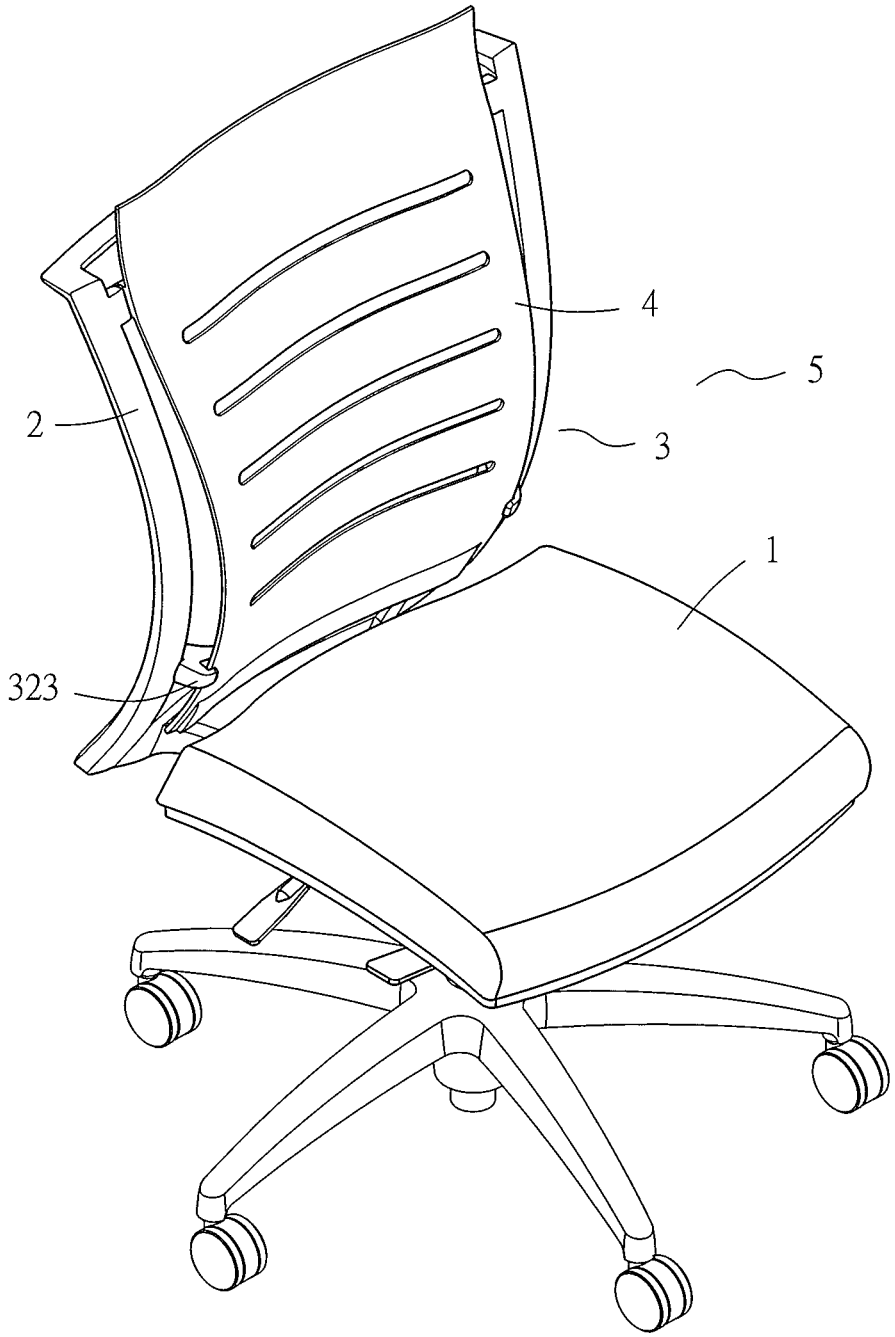
FIG. 3 is an assembled front perspective view of the lower-back supporting device in FIG. 2.

The movement-limiting units 3 mounted respectively on the two corresponding inner lateral sides of the backrest panel frame 2 of the chair 5 not only clamp the backrest panel 4 but also can be displaced vertically with respect to the backrest panel 4. Referring to FIG. 5 and FIG. 6, the pressing section 323 on one side of each clamping member 32 is engaged with one lateral portion of the backrest panel 4, as shown in FIG. 3. The clamping members 32 can be displaced vertically along the respective slide rails 31, as shown in FIG. 6 and FIG. 7, while clamping the peripheral portion of the backrest panel 4, which is elastic and whose upper sections are retained by the backrest panel frame 2. The section of the backrest panel 4 that is bilaterally clamped by the clamping members 32 protrudes forward and thus forms a lower-back supporting area 41 at a predetermined height, as shown in FIG. 6A and FIG. 7A. The present invention, therefore, allows users of different statures to sit on the chair 5, lean elastically on the backrest panel 4, and have their lower as well as upper back properly supported.

What is claimed is:

1. A lower-back supporting device of a chair, configured to enable convenient adjustment in height of a lower-back supporting area on a rear side of the chair so that the lower-back supporting area can be leaned on comfortably, with the lower-back supporting device comprising: a hollow backrest panel frame formed along a rear side of a seat of the chair; a separately formed backrest panel which is elastic, is mounted to the backrest panel frame, and has upper sections retained by the backrest panel frame; and a movement-limiting unit extending from a predetermined area of each of two inner lateral sides of the backrest panel frame, wherein the movement-limiting units on the two inner lateral sides of the backrest panel frame correspond to and are configured to clamp predetermined sections of a peripheral portion of the backrest panel, wherein the movement-limiting units extending respectively from the two inner lateral sides of the backrest panel frame are received in receiving spaces concavely provided in predetermined areas of the two inner lateral sides of the backrest panel frame and each comprise a slide rail, a clamping member, and a connecting member, wherein: the slide rail has a middle section penetrated by a slot through which a projection extending from an end of the connecting member extends; the slide rail has an inner side concavely provided with a space; the space has a lateral side concavely formed with a recess; the connecting member has a stop portion formed on a side of and spaced from the connecting member and pushing outward constantly; the connecting member is displaceable along the space in order for the stop portion to be temporarily restricted by said recess of the slide rail; the clamping member is pressed against an outer side of the slide rail; the projection of the connecting member extends through the slot of the slide rail and is received in a groove of the clamping member; a threaded fastener is fastened in a hole of the connecting member and a hole of the clamping member to fix the connecting member and the clamping member together; the clamping member has a side formed with a recessed pressing section for clamping a corresponding peripheral portion of the backrest panel even when the clamping member is vertically displaced; and when the movement-limiting units of the two inner lateral sides are vertically displaced to a predetermined height, the backrest panel protrudes forward, and thus forms the lower-back supporting area, at the predetermined height in order to be leaned on elastically.

2. The lower-back supporting device of claim 1, wherein a sunken area is provided in a predetermined section of said clamping member, and wherein the clamping member is displaceable along the outer side of the slide rail in a stable manner while pressed against the outer side of the slide rail.

* * * * *